US007506766B2

(12) United States Patent
Mathis, Jr. et al.

(10) Patent No.: US 7,506,766 B2
(45) Date of Patent: Mar. 24, 2009

(54) APPARATUSES AND METHODS FOR SEPARATING MIXED MATERIALS

(75) Inventors: Oscar L. Mathis, Jr., Cary, IL (US); Gordon J. Frank, Barrington, IL (US); Derek Kerkera, Crystal Lake, IL (US)

(73) Assignee: General Kinematics Corporation, Crystal Lake, IL (US)

( * ) Notice: Subject to any disclaimer, the term of this patent is extended or adjusted under 35 U.S.C. 154(b) by 0 days.

(21) Appl. No.: 11/669,056

(22) Filed: Jan. 30, 2007

(65) Prior Publication Data

US 2007/0221546 A1 Sep. 27, 2007

Related U.S. Application Data

(60) Provisional application No. 60/763,716, filed on Jan. 31, 2006.

(51) Int. Cl.
*B07B 1/28* (2006.01)

(52) U.S. Cl. ..... 209/320; 209/321; 209/254; 209/261

(58) Field of Classification Search ..... 209/254, 209/261, 313, 320, 321, 920, 921, 11, 238
See application file for complete search history.

(56) References Cited

U.S. PATENT DOCUMENTS 351,037 A * 10/1886 Brinkman ..... 428/84
507,971 A * 10/1893 Combs ..... 209/320
549,918 A * 11/1895 Holmes ..... 209/394
1,039,785 A * 10/1912 Nevill ..... 198/740
3,335,861 A 8/1967 Musschoot et al.
3,645,381 A * 2/1972 Smiltneek ..... 198/760
3,989,227 A 11/1976 Musschoot
4,565,279 A 1/1986 Musschoot
4,715,950 A * 12/1987 Danner et al. ..... 209/20

(Continued)

FOREIGN PATENT DOCUMENTS

EP 0 815 956 1/1998

(Continued)

OTHER PUBLICATIONS

Extended Search Report issued by the European Patent Office in regard to the Counterpart EP application (5 pages).

*Primary Examiner*—Patrick H Mackey
*Assistant Examiner*—Terrell H Matthews
(74) *Attorney, Agent, or Firm*—Marshall, Gerstein & Borun LLP

(57) ABSTRACT

An apparatus includes a separation deck free of stepwise changes in elevation between a first end and a second end, the separation deck comprising a plurality of spaces through which a constituent material may pass, a plurality of scrubbers disposed on the deck, the plurality of scrubbers having a first end disposed at a higher elevation than the deck in at least a first state, and a vibratory generator coupled to the deck. The mixed material moves over the deck and the scrubbers from the first end to the second end by the motion imparted by the vibratory generator. Components of the mixed material move relative to each other as the components move over the scrubbers, thereby causing the constituents material attached to the components of the mixed material to separate and pass through the spaces in the separation deck.

18 Claims, 13 Drawing Sheets

U.S. PATENT DOCUMENTS

| | | | | |
|---|---|---|---|---|
| 5,108,589 | A | 4/1992 | Sherman | |
| 5,746,322 | A | 5/1998 | La Veine et al. | |
| 5,984,105 | A * | 11/1999 | Lease et al. | 209/37 |
| 6,453,982 | B1 * | 9/2002 | Musschoot et al. | 164/404 |
| 6,464,082 | B1 * | 10/2002 | Kimmel et al. | 209/12.1 |
| 6,729,476 | B1 | 5/2004 | Sjoholm | |
| 2007/0068852 | A1 * | 3/2007 | Lease et al. | 209/314 |

FOREIGN PATENT DOCUMENTS

| | | |
|---|---|---|
| FR | 2 519 886 | 7/1983 |
| FR | 2 545 385 | 11/1984 |
| FR | 2 866 527 | 8/2005 |

* cited by examiner

APPARATUSES AND METHODS FOR SEPARATING MIXED MATERIALS

This application claims the benefit under 35 U.S.C. 119(e) of U.S. Provisional Application No. 60/763,716, filed Jan. 31, 2006, which is hereby incorporated by reference in its entirety in the present application.

BACKGROUND

This patent is directed to apparatuses and methods for separating mixed materials, and, in particular, to apparatuses and methods for separating mixed material utilizing a vibratory generator.

It is not uncommon for materials to be processed or that have been processed to include more than one material component. A smaller component may become attached to the surface of a larger component, for example, where the larger component has an irregular surface or a surface on which a sticky or tacky material is disposed. As one such example, dirt and sand may become attached to harvested crops, which crops may need to undergo further processing before they are packaged and sold to the consumer.

One method by which the materials may be separated from each other (e.g., the sand and dirt separated from the crops) is through washing. That is, one or more streams or jets of water or other solvent may be directed on or through, for example, the crops to separate the sand and dirt from the crops. Alternatively, the crops may be passed through an enclosed body of water or other solvent, such as a tank or bath. The washed crops can then be processed, and the stream of waste water, sand and dirt can be collected for disposal.

Unfortunately, washing with water or other solvents can have drawbacks. It is often the case that the water or other solvent can carry away not only the targeted component of the mixed material (e.g., the sand and dirt), but it may carry away other components of the mixed material as well. For example, by washing harvested crops, undesirable materials, such as phosphates (which may be used in conjunction with the crops as a fertilizer), may be carried away in the waste water. This may make disposal of the waste water more difficult. As another example, materials that would have commercial value, such as the juice of the harvested product, may be carried away in the waste water stream.

Consequently, it is desired to have alternative apparatuses and methods for separating mixed materials into their components.

SUMMARY

According to an aspect of the present disclosure, an apparatus for separating a mixed material into constituent materials includes a separation deck free of stepwise changes in elevation between a first end and a second end, the separation deck comprising a plurality of spaces through which a constituent material may pass, a plurality of scrubbers disposed on the deck, the plurality of scrubbers having a first end disposed at a higher elevation than the deck in at least a first state, and a vibratory generator coupled to the deck. The mixed material moves over the deck and the scrubbers from the first end to the second end by the motion imparted by the vibratory generator. Components of the mixed material move relative to each other as the components move over the scrubbers, thereby causing the constituents material attached to the components of the mixed material to separate and pass through the spaces in the separation deck.

According to another aspect of the present disclosure, a system includes a separator for separating a mixed material into constituent materials, the separator including a separation deck free of stepwise changes in elevation between a first end and a second end, the separation deck comprising a plurality of spaces through which a constituent material may pass, a plurality of scrubbers disposed on the deck, the plurality of scrubbers having a first end disposed at a higher elevation than the deck in at least a first state, and a vibratory generator coupled to the deck. The mixed material moves over the deck and the scrubbers from the first end to the second end by the motion imparted by the vibratory generator. Components of the mixed material move relative to each other as the components move over the scrubbers, thereby causing the constituents material attached to the components of the mixed material to separate and pass through the spaces in the separation deck. The system may also include, for example, a furnace coupled to a separator, at least a portion of the materials moving over the deck and the scrubbers of the separator being directed into the furnace.

According to a further aspect of the present disclosure, a method of separating a mixed material into constituent materials includes moving a mixed material along a separation deck, the separation deck free of stepwise changes in elevation between a first end and a second end, the separation deck comprising a plurality of spaces through which a constituent material may pass, and contacting the mixed material with a plurality of scrubbers disposed on the deck, the plurality of scrubbers having a first end disposed at a higher elevation than the deck in at least a first state. Components of the mixed material move relative to each other as the components move over the scrubbers, thereby causing the constituents material attached to the components of the mixed material to separate and pass through the spaces in the separation deck.

DETAILED DESCRIPTION OF VARIOUS EMBODIMENTS

Although the following text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
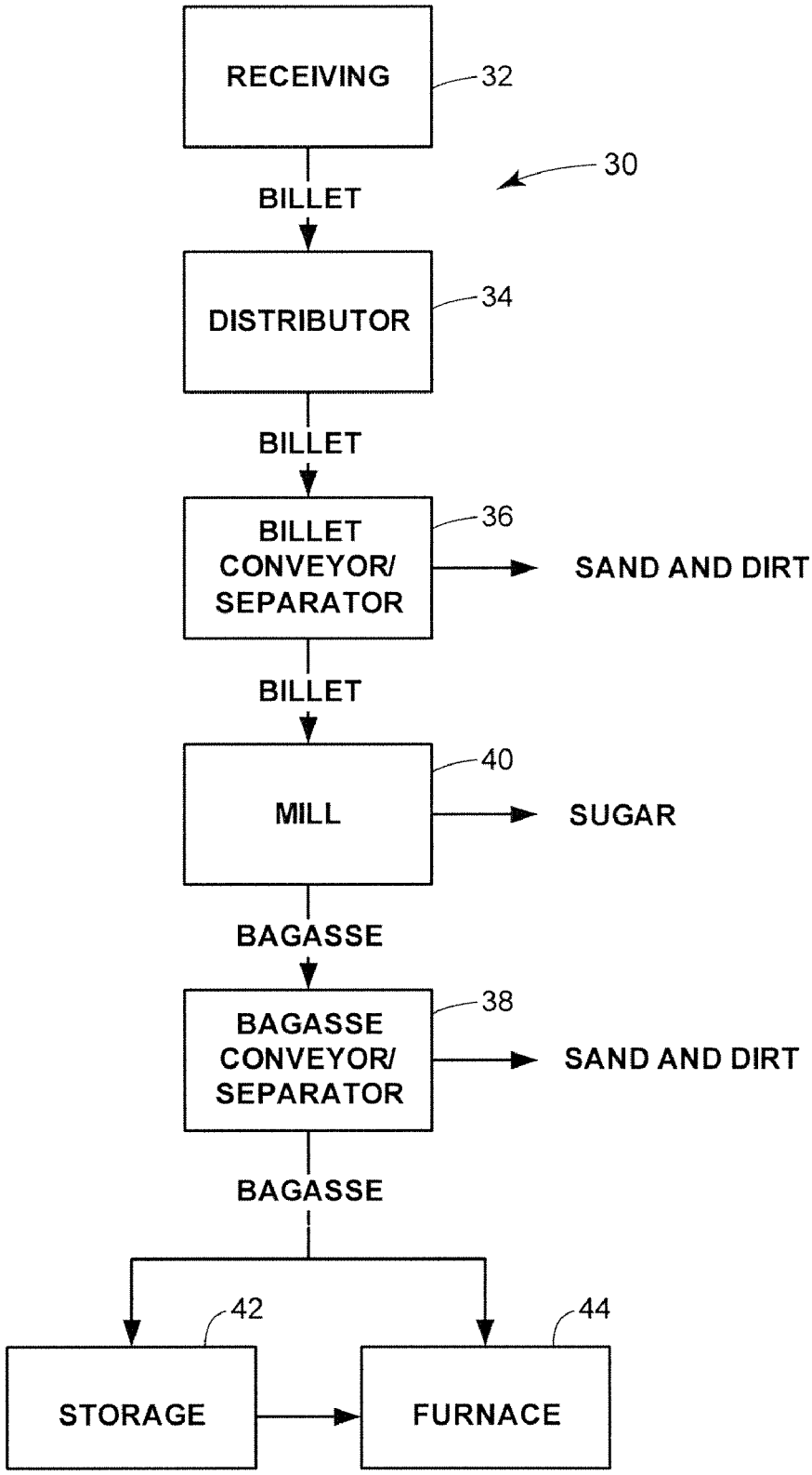
FIG. 1 is block diagram illustrating, in part, a system for separating mixed materials and the subsystems thereof.

FIG. 1 is a block diagram showing, in part, a system 30 for separating, and conveying, mixed materials. The system 30 is shown combined with other devices to define a system for the processing of sugar cane into cane squeezings, although the system 30 is not so limited. However, the system 30 may be advantageously used in combination with such devices and subsystems to define such a sugar cane processing system, and understanding of the structure and operation of the system 30 is facilitated by discussing the system 30 in the context of the sugar cane processing system.

The system 30 includes a receiving subsystem 32, a distributor 34, a billet conveyor/separator 36, and a baggasse conveyor/separator 38. Of these various subsystems of the system 30, the distributor 34, the billet conveyor/separator 36 and the bagasse conveyor/separator 38 are explained in greater detail below with reference to the Figures. The system 30 is illustrated in combination with a mill 40, storage 42 and a boiler furnace 44, the structure and operation of which in combination with the system 30 is also discussed in greater detail below.

Generally, in harvesting sugar cane, the entire sugar cane stalk is removed from the ground, occasionally even upending the roots of the plant, referred to as the root ball. The stalk is then cut into sections referred to as billet (nominal 12 inch length). The billet tends to be tacky to the touch. As a consequence of the tackiness of the billet and other causes, such as the inclusion of billet with rootballs still attached, a substantial amount of dirt and sand (e.g., 5-11% by weight) becomes attached to the billet, and is transported along with the billet to the receiving subsystem 32.

The receiving subsystem 32 may include a hopper (not shown) into which the billet is loaded from the transport, typically a trailer or a railcar. The receiving subsystem 32 further may include conveyors (not shown), which may be vibratory conveyors, belt conveyors, etc. The conveyors move the billet from the hopper to the distributor 34.

The distributor 34 receives the incoming stream of billet from the receiving subsystem 32, and spreads the billet stream out over a wider front than that of the conveyors used in the receiving subsystem 32. The distributor 34 may also cause the billet stream to change direction, to make a right turn, for example. While the distributor 34 is not necessary to the operation of the billet conveyor/separator 36, the operation of the distributor 34, especially the spreading out of the billet stream over a wider front, facilitates the operation of the billet conveyor/separator 36. It will be recognized that the billet conveyor/separator 36 must be of a suitable width to accommodate the spreading of the billet stream over a wider front, which width may be provided by using a plurality of individual conveyor/separators 36 in parallel.

The billet conveyor/separator 36 includes a series of separation decks and scrubbers, as is explained in greater detail below. In summary, a vibratory generator is coupled to the separation decks, and the movement of the billet across the separation decks causes the dirt and sand to become separated from the billet. Additionally and advantageously, the scrubbers cause the billet to interact, thereby enhancing the separation of the dirt and sand from the billet. Two material streams exit the billet conveyor/separator: billet, which includes billet that is substantially free of dirt and sand but may still have some dirt and sand attached, and waste, including dirt and sand. The billet is passed along to the mill 40, while a conveyor carries the waste away.

In the mill 40, the billet is shredded to string-like consistency. This string-like material is squeezed, rewetted, and squeezed again (and potentially several times more) to release the sucrose or sugar contained therein. The solids remaining after this processing are referred to as bagasse. The bagasse, which may include some fraction of dirt and sand, exits the mill, as do the cane squeezings. It is believed that the use of the billet conveyor/separator 36 assists in limiting the amount of sand and dirt in the cane squeezings, thereby reducing the amount of sand and dirt that must be removed later in the refining process.

All, some or none of the bagasse from the mill 40 may now be passed along to the bagasse conveyor/separator 38. In the alternative, all, some or none of the bagasse may be passed along to the boiler furnace 44 to be burned to provide power for the operation of the sugar cane processing system, of which the system 30 is a part. As a further alternative, the bagasse may be conveyed to a storage area 42, where it may be retained for later use in the furnace 44.

As noted above, all or some of the bagasse from the mill 40 may be passed to the bagasse conveyor/separator 38. It may be advantageous to convey the bagasse from the mill 40 to the conveyor/separator 38 to permit the conveyor/separator 38 to remove additional impurities, such as retained dirt and sand, from the bagasse prior to combustion in the furnace 44. Impurities, such as dirt and sand, can cause abrasion of the thin wall tubes of the boiler, leading to increased maintenance and shortened life expectancy for the tubes. While the separation of dirt and sand at the billet conveyor/separator 36 may have a significant positive effect on the abrasion problem, further separation in the conveyor/separator 38 may provide further positive effect.

In this regard, it will be recognized that if the primary focus of dirt and sand removal is to limit the amount of dirt and sand entering the furnace 44, it may not be necessary to include both the billet conveyor/separator 36 and the bagasse conveyor separator 38. In fact, the billet conveyor/separator 36 may be removed entirely in favor of the bagasse conveyor/separator 38, the conveyor/separator 38 providing the desired separation of sand and dirt from the bagasse, thereby limiting the amount of sand and dirt entering the furnace 44. Of course, by omitting the billet conveyor/separator 36, the amount of sand and dirt which may be passed along with the cane squeezings from the mill 40 will be higher than if the billet conveyor/separator 36 were used, although this could be obviated through the use of an alternate separation technology.

Having thus explained the system 30 in the context of the sugar cane processing system illustrated in FIG. 1, the distributor 34, billet conveyor/separator 36 and bagasse conveyor/separator 38 are now individually explained with reference to FIGS. 2-20.

Figure 2:
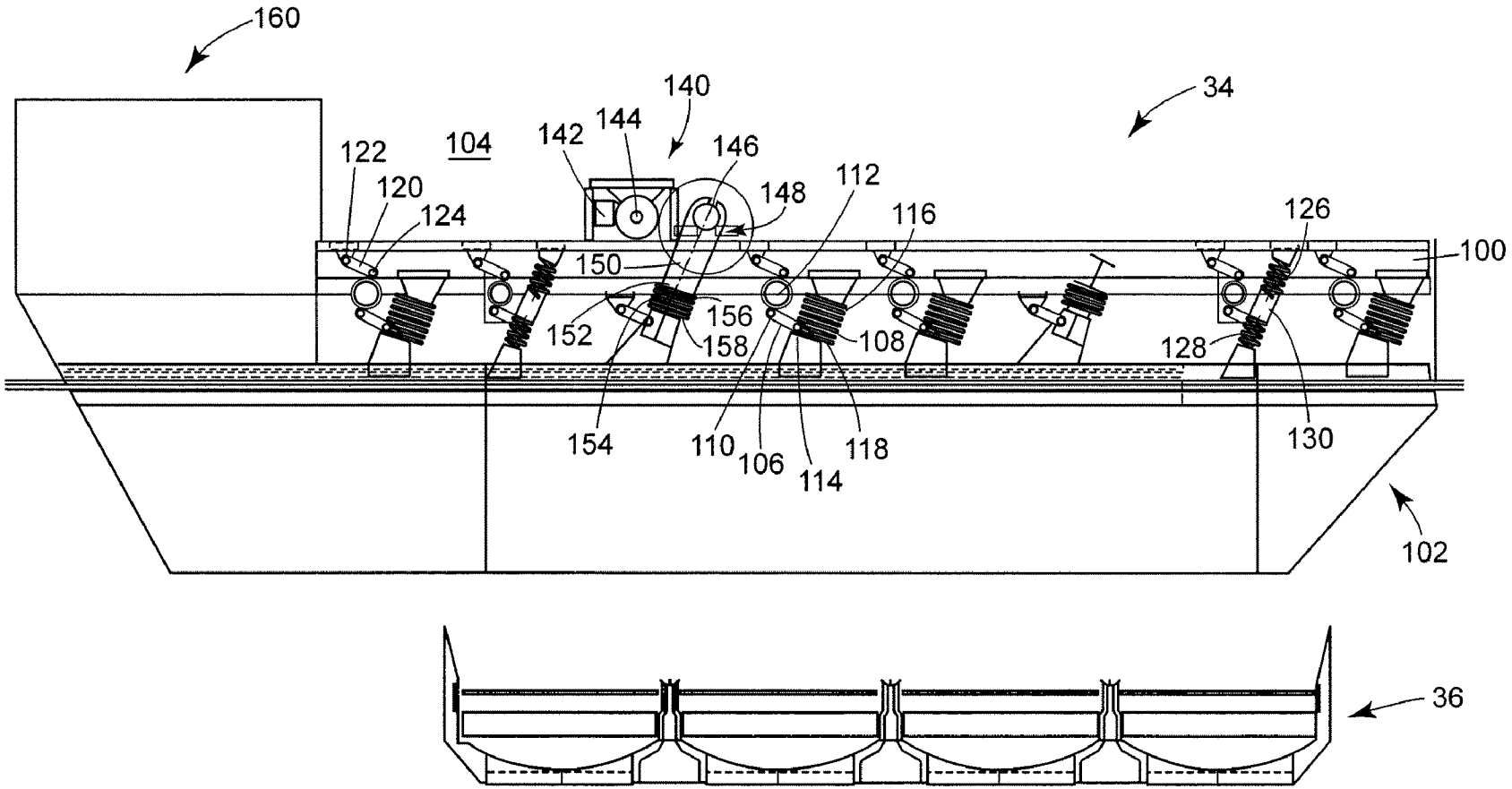
FIG. 2 is a side elevation view of a distributor for use in the system of FIG. 1.
Figure 3:
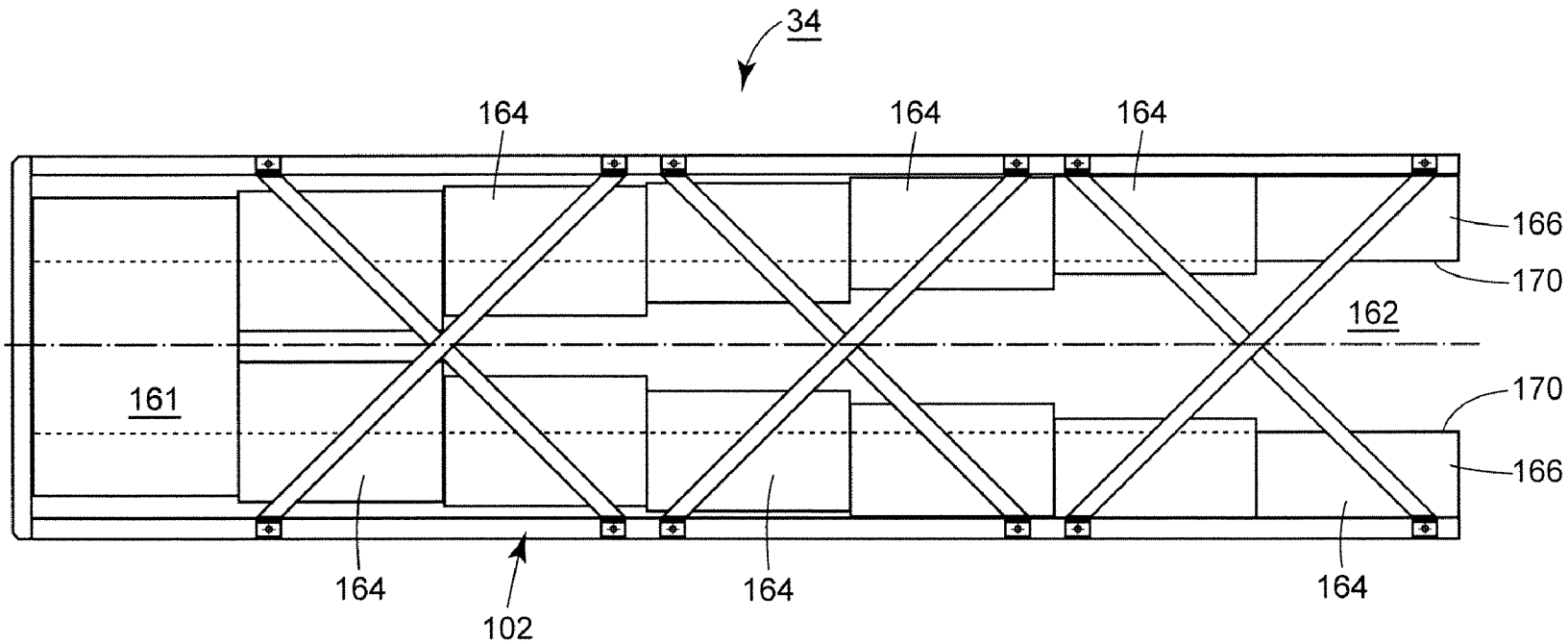
FIG. 3 is a plan view of the distributor of FIG. 2.
Figure 4:
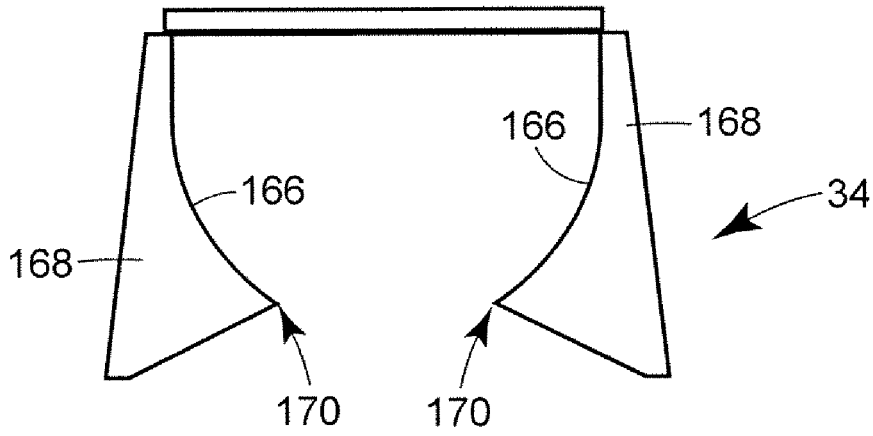
FIG. 4 is an end view of the distributor of FIG. 2.

Turning first to FIGS. 2-4, and in particular FIG. 2, the distributor 34 may be disposed at an elevation above the billet conveyor/separator 36, or, more particularly, a plurality of billet conveyor/separators 36. Material from the receiving subsystem 32 enters the distributor 34 at the left-hand side as shown in FIG. 2. The material from the receiving subsystem 32 may enter the distributor 34 in the plane of the page, or may enter the distributor 34 at an angle to the plane of the page. The material is then conveyed and distributed along the length of the distributor 34 to the plurality of conveyor/separators 36.

The distributor 34 includes a counterbalance 100 and a trough 102, with the trough 102 disposed beneath the counterbalance 100. Both the counterbalance 100 and the trough 102 may be attached to a frame, represented generally at 104. The position of the trough 102 beneath the counterbalance 100 and frame 104 may permit a less restricted flow of material from the distributor 34 into the billet conveyor/separators 36.

The counterbalance 100, trough 102, and frame 104 may be connected to each other by one or more links and resilient members. In particular, the trough 102 may be coupled to the frame 104 by a plurality of rigid links 106 and to the counterbalance 100 by a plurality of resilient members 108. The rigid links 106 may each be pivotally attached at a first end 110 to the frame 104 via a support structure (for example, a tube) 112 and at a second end 114 to the trough 102, and the angle formed between each rigid link 106 and the trough 102 may be an obtuse angle. The resilient members 108, which may be coil springs, may each be fixedly attached at a first end 116 to the counterbalance 100 and a second end 118 to the trough 102, and the angle formed between each resilient member 108 and the trough 102 may be an acute angle. As illustrated, the plurality of links 106 and the plurality of resilient members 108 may be disposed in pairs, with the ends 114 of the links 106 and the ends 118 of the resilient members 108 that make up each pair being attached to the trough 102 adjacent each other.

The counterbalance 100 may also be coupled to the frame 104 by rigid links 120 that are connected at a first end 122 to the counterbalance 100 and a second end 124 to the tubes 112. Additionally, the counterbalance 100 and the trough 102 may also be coupled via resilient members 126, 128, which may be springs, to the frame 104 via a support structure 130.

Coupled between the counterbalance 100 and the trough 102 is a vibratory generator 140. The vibratory generator 140 may include a motor 142 with a shaft 144. The motor shaft 144 may be coupled to a driven shaft 146 by a drive belt (not shown). The driven shaft 146 may be an eccentric shaft. Attached to the eccentric shaft 146 is a first end 148 of a link 150. A second end 152 of the link 150 is attached via a resilient member 154 to the trough 102; that is, a first end 156 of the resilient member 154 is fixedly secured to the second end 152 of the link 150, while the second end 158 of the resilient member 154 is fixedly secured to the trough 102.

As is also the case with the conveyor/separators 36, 38 described below, while one embodiment of a structure for coupling counterbalance 100, trough 102, and frame 104 and one embodiment of a vibratory generator 140 have been discussed, other structures and generators may be used according to the knowledge of one skilled in the art. For example, a different structure for connecting the base, or balancer, and trough is illustrated regarding the billet conveyor/separator 36 and the bagasse conveyor/separator 38, a modified form of which (to support from above, instead of from below, for example) may be used with the trough 102. Additionally, a brute force vibratory generator or a two-mass vibratory generator may be used according to another embodiment.

As seen in FIGS. 2 and 3, the trough 102 has an inlet end 160, at which an inlet plate 161 is disposed to initially receive the material passing from the receiving subsystem 32. The trough 102, as stated above, discharges along its length through a discharge opening 162 into the billet conveyor/separator 36, or more particularly a plurality of billet conveyor/separators 36. In particular, the trough 102 includes a plurality (six as illustrated) of trough segments 164, each trough segment 164 including opposing plates 166 supported on frames 168 (see also FIG. 4). Opposing, spaced edges 170 define the discharge opening 162.

As is also illustrated in FIG. 3, the spacing between the opposing edges 106 of the plates 166 may be varied one segment 164 to the next. As illustrated, the distance between the edges 170 of the plates 166 of the leftmost segment 164 is considerably smaller than that of the rightmost segment 164, causing the opening 162 to have its widest dimension at the rightmost end and its smallest dimension at the leftmost end. Other arrangements are possible, including an embodiment wherein the distances between the edges 170 of the plates 164 are uniform, providing a discharge opening 162 of uniform dimension.

Figure 5:
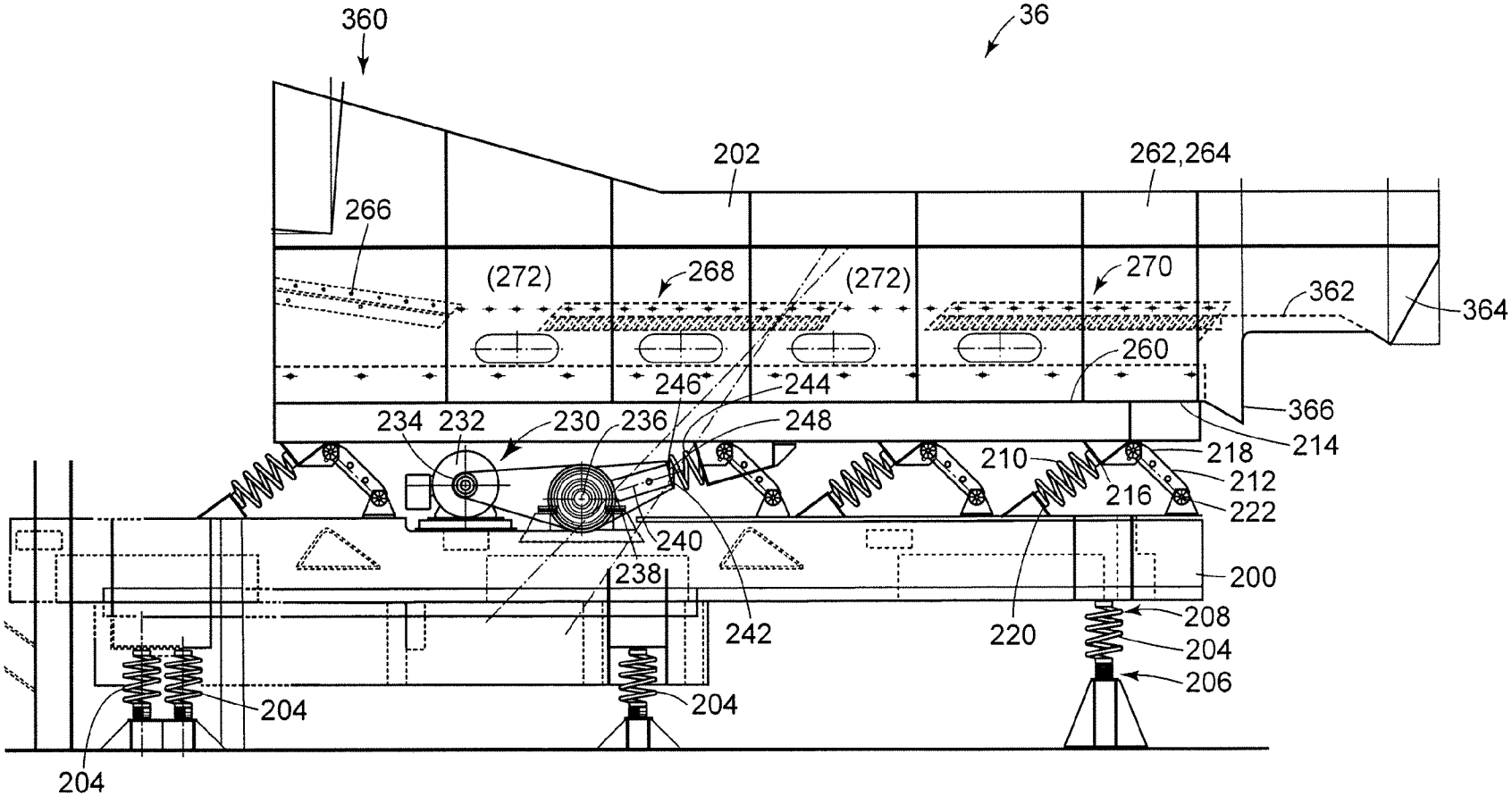
FIG. 5 is a side elevation view of a billet conveyor/separator for use in the system of FIG. 1 with the scrubbers removed for ease of illustration.
Figure 6:
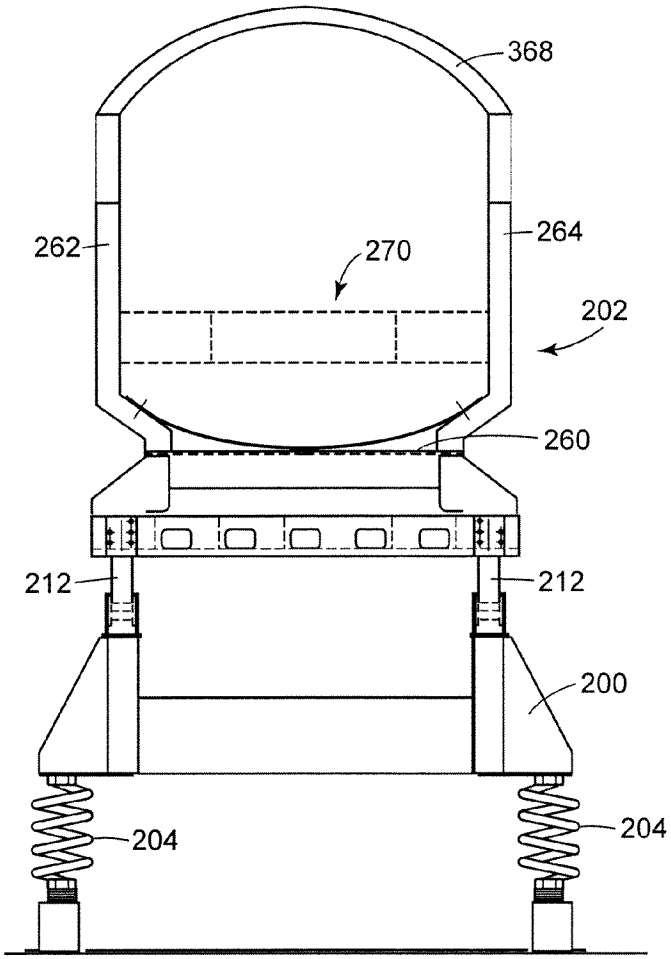
FIG. 6 is a an end view of the billet conveyor/separator of FIG. 5.

Turning next to FIGS. 5-11, and in particular FIGS. 5 and 6, the billet conveyor/separator 36 has a weighted base 200 and a trough or bed 202. The base 200 of the billet conveyor/separator 36 may be supported on multiple resilient members 204, each of which as a first end 206 that is attached or anchored to the ground and a second end 208 that is attached to the base 200. The resilient members 204 may be referred to as isolators or isolation springs, and according to one embodiment may be compression, coil springs. The trough 202 is supported on resilient members 210 and linkages 212, which resilient members 210 may be disposed at obtuse angles to the bottom 214 of the trough 202 and which linkages may be disposed at acute angles to the bottom 214. The first ends 216, 218 of the resilient members 210 and the linkages 212 may be attached to the trough 202 at substantially the same point along the trough 202, while the second ends 220, 222 may be spaced from each other. The resilient members 210 may be referred to as reactor coils, and according to one embodiment may be compression, coil springs.

Like the distributor 34, coupled between the base 200 and the trough 202 of the billet conveyor/separator 36 is a vibratory generator 230. The vibratory generator 230 may include a motor 232 with a shaft 234. The motor shaft 234 may be coupled to a driven shaft 236 by a drive belt (not shown). The driven shaft 236 may be an eccentric shaft. Attached to the eccentric shaft 236 is a first end 238 of a link 240. A second end 242 of the link 240 is attached via a resilient member 244 to the trough 202; that is, a first end 246 of the resilient member 244 is fixedly secured to the second end 242 of the link 240, while the second end 248 of the resilient member 244 is fixedly secured to the trough 202.

As best seen in FIG. 6, the trough 202 includes a floor 260 to which side walls 262, 264 are attached. Disposed between the side walls 262, 264 and above the floor 260 are an inlet plate 266 and two separation decks 268, 270, as illustrated in FIG. 5. Disposed between the inlet plate 266 and the separation deck 268 and between the separation decks 268, 270 are mechanical scrubbers 272, which are not shown in FIG. 5 for ease of illustration, but are instead illustrated according to a preferred installation in FIGS. 9-11. While the scrubbers 272 between the inlet plate 266 and deck 268 and between decks 268, 270 are of similar structure and operation according to this embodiment, according to other embodiments, the scrubbers located between the inlet plate 266 and deck 268 and between decks 268, 270 may be of different structure and operation.

Starting then at the leftmost end of the conveyor/separator 36, the inlet plate 266 may include one or more plates that are attached at spaced ends to the side walls 262, 264. Materials entering the conveyor/separator 36 impact the inlet plate 266 initially, as opposed to impacting one of the decks 268, 270 or the scrubbers 272. This is believed to limit the exposure of the decks 268, 270 and scrubbers 272 to the force of the materials falling from the distributor 34.

The decks 268, 270 are configured with a plurality of apertures defined therein to permit smaller items to pass through the decks 268, 270 and be collected on the floor 260 (on which may be disposed a liner) of the trough 202, and larger items to pass along the decks 268, 270. According to one embodiment, the decks 268, 270 may each be defined by one or more finger screens 280, similar to those disclosed in U.S. Pat. No. 5,108,589, which is incorporated by reference herein in its entirety. It will be understood that while each separation deck 268, 270 is illustrated as including two finger screens 280, a greater or lesser number of screens may be included. Likewise, it will also be understood that while finger screens 280 are illustrated in the drawings of the present embodiment, other screens may be used as well.

Figure 7:
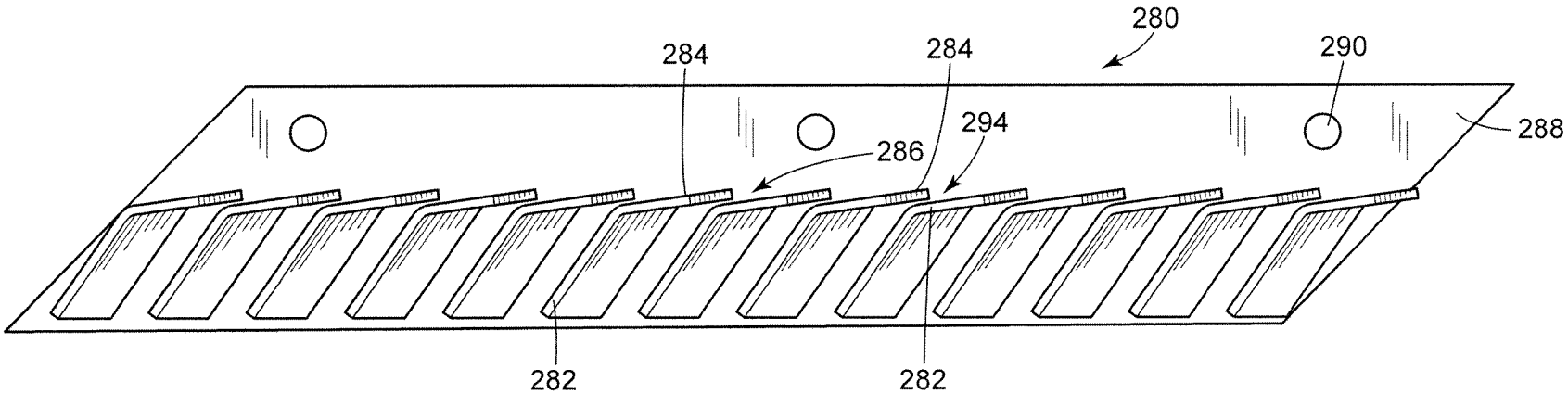
FIG. 7 is an enlarged, cross-sectional view of a finger screen for use in a separation deck of the billet conveyor/separator of FIG. 5.
Figure 8:
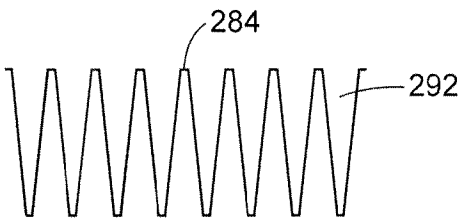
FIG. 8 is an enlarged, partial plan view of the finger screen of FIG. 7.

As is shown in greater detail in FIG. 7, each finger screen 280 may include a plurality of L-shaped plates 282, each plate 282 having a plurality of protrusions 284 (shown in enlarged view in FIG. 8) defined along the length of a first edge 286 thereof. The protrusions 284 define the "fingers" of the finger screen 280. The L-shaped plates 282 may be attached to a pair of mounting plates 288 (one of which is shown in FIG. 7) at either end of the L-shaped plates 282. The mounting plates 288 may have a plurality of apertures 290 formed therethrough to allow the screens 282 to be secured to the side walls 262, 264 of the trough 202, by fasters such as nuts and bolts, for example. In this way, the screens 280 may be selectively removed from the trough 202 for maintenance, repair and/or replacement.

The protrusions, or fingers, 284 define between them a plurality of spaces 292 (see FIG. 8) that permit certain constituent materials from a mixed material stream to pass therethrough, while limiting the passage of other materials in the mixed material stream. Additionally, the protrusions 284 of one L-shaped plate 282 may overlap with at least a portion of an adjacent L-shaped plate 282, but without abutting the adjacent L-shaped plate 282. As a consequence, a further space 294 (see FIG. 7) is defined between the protrusions 284 and the adjacent L-shaped plates 282 through which certain materials may pass, while the passage of other materials therethrough may be limited. According to the present embodiment, the spaces 292, 294 may be of equal distance across.

Figure 10:
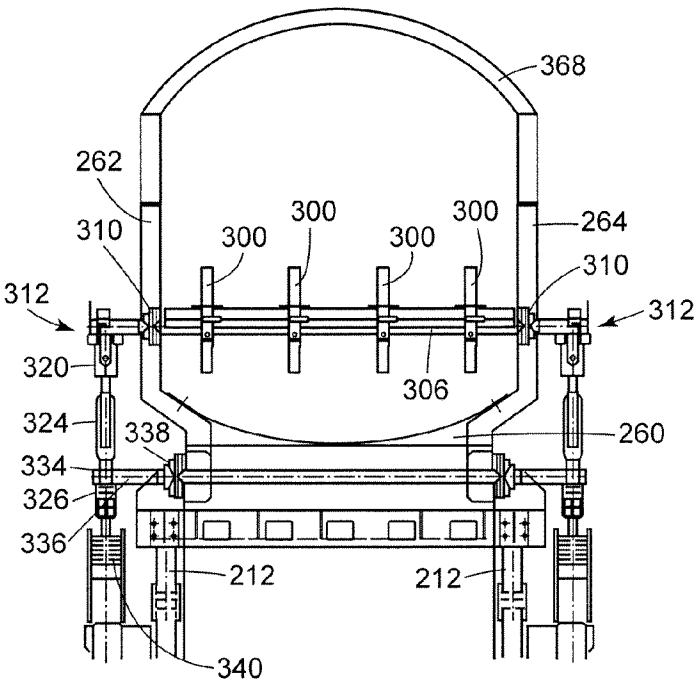
FIG. 10 is an enlarged, cross-sectional view of the billet conveyor/separator of FIG. 5 showing the scrubber according to the first embodiment installed for use.
Figure 9:
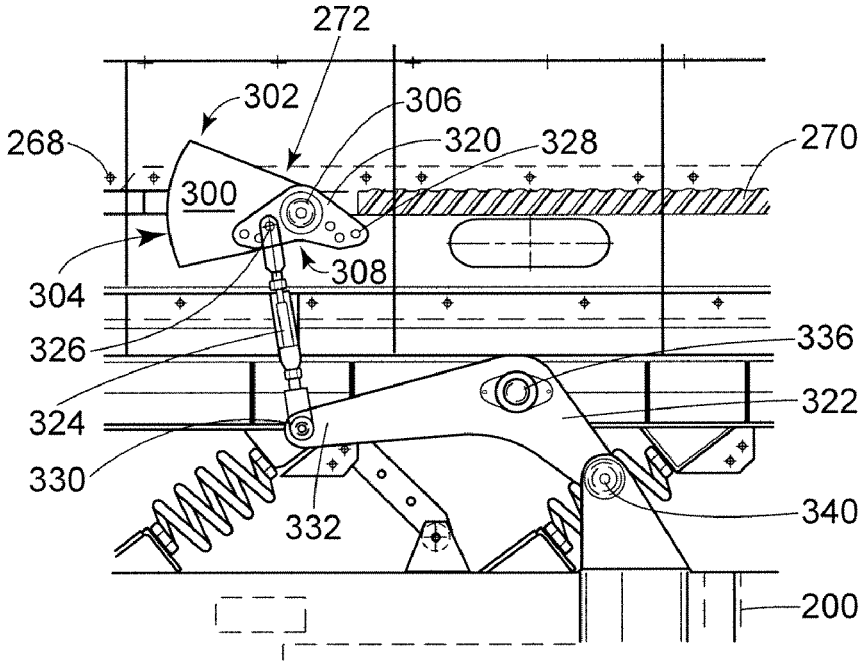
FIG. 9 is an enlarged, partial side elevation view of a scrubber according to a first embodiment installed for use in the billet conveyor/separator of FIG. 5.
Figure 11:
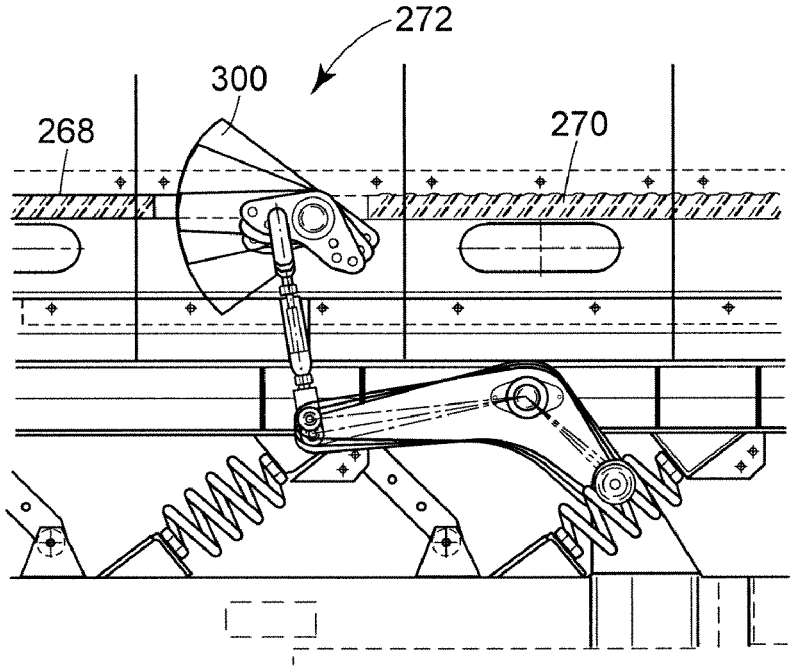
FIG. 11 is an enlarged, partial side elevation view of the scrubber according to the first embodiment shown in various operational positions.

Reference is now made relative to FIGS. 9-11, and the mechanical scrubbers 272. As is illustrated in FIGS. 9 and 10, the mechanical scrubbers 272 each include a plurality of cams 300. The cams 300 may have pie- or wedge-shape as viewed in FIG. 9, with a flat, upper surface 302 and an arcuate, leading surface 304.

The cam 300 is pivotally mounted on a shaft 306 at an end 308 opposite the arcuate, leading surface 304 so as to be pivotally mounted relative to the trough 202. In this regard, the cams 300 are attached to the shaft 306 so as to rotate with the shaft 306, but so that relative rotation between the cams and the shaft 306 is limited (e.g., by keying the cams 300 to the shaft 306). The shaft 306 depends between the side walls 262, 264 of the trough 202, and is connected to the side walls 262, 264 through bearings 310. Ends 312 of the shaft 306 extend beyond the bearings 310, and permit the shaft 306 to be connected to the remainder of the scrubber 272.

The remainder of scrubber 272, which may be referred to as the drive section, is but a single example of the myriad different mechanisms that may be proposed to rotate the shaft 306, and thus the cams 300. The drive section includes an arcuate adjustment plate 320, an L-shaped rocker arm 322, and a straight link 324 (although a resilient member, e.g., a coil spring, may be used instead). The adjustment plate 320 is fixedly attached to one of the ends 312 of the shaft 306. The link 324 has a first end 326 that may be attached to one of a plurality of holes 328 in the adjustment plate 320 and a second end 330 that may be attached to one end 332 of the arm 322. The arm 322 is pivotally attached to the trough 202 by being fixedly attached to one end 334 of a shaft 336 that is pivotally mounted, using bearings 338, to the trough 202. Another end 340 of the rocker arm 334 is pivotally coupled to the base 200. As a consequence, motion of the base 200 relative to the trough 202 is transmitted through the drive section to cause the cams 300 to move.

The cams 300 may be made to move about pivot 308 between a first position, wherein the upper surface 302 is parallel the surface of the screens 280, and a second position, wherein the upper surface 302 is at an angle relative to the surface of the screens 280. In the second position, the leading surface 304 would be facing the on-coming billet stream. FIG. 11 illustrates the movement of the cam 300 through the range of positions discussed.

It is believed that the motion of the cams 300 between the first and second positions may cause the individual billets to move relative to each other in the trough 202. It is further believed that the relative motion of the billet may cause the dirt and sand on the outer surface of the billet to be removed from the surface of the billet, or at least loosened from the surface of the billet. In any event, it is believed that the dirt and sand that has been removed or loosened from the billet is more readily separated from the billet during its traverse across the decks 268, 270.

Furthermore, it is believed that the use of the mechanical scrubbers 272 in the billet conveyor/separator 36 may assist in limiting the overall height of the conveyor/separator 36. That is, an alternative method for causing the billet to interact would be to allow the billet to fall from a higher elevation to a lower elevation in between the inlet plate 266 and the separation decks 268, 270. However, a consequence of such a method would be that the separator would need to be of a relatively large height between inlet and discharge. Through the use of the mechanical scrubbers 272, it is believed that the interaction between the billet is at least as effective as if the falling method were used, while removing the necessity of having a separator of relatively large height caused by the need to provide periodic falls from higher to lower elevation.

It should be noted that, as illustrated in FIG. 10, both ends 312 of the shaft 306 are shown coupled to the base 200 through a drive section including plate 320, rocker arm 322, and link 324. However, it will be recognized that according to other embodiments, only one end 312 of the shaft 306 may be coupled to the base 200 through a drive section. Both embodiments are embraced within the disclosure made herein.

Returning now to FIG. 5, in operation, the billet with associated dirt and sand enters the trough 202 at an inlet end 360, and impinges upon the inlet plate 266. As the billet moves along the trough 202, the pieces of billet are moved relative to each other by the action of the cams 300 of the scrubber 272 disposed upstream of the deck 268. As the billet is conveyed past the scrubber 272, it passes over the separation deck 268, and some amount of dirt and sand passes through the spaces 292, 294 and is deposited on the floor 260 (or, according to the illustrated embodiment, a liner, which may still be referred to as being deposited on the floor) of the trough 202. The billet then passes through the second scrubber 272 and over the second separation deck 270, whereby further dirt and sand is removed from the billet. Of course, dirt and sand may also be removed by the action of the scrubbers 272, which dirt and sand also may be deposited on the floor 260 of the trough 202. As the billet is moved over the decks 268, 270 and scrubbers 272 by the motion imparted by the vibratory generator 230, so too is the dirt and sand moved along the floor 260. The billet eventually is moved past the deck 270, over a discharge plate 362, and out a billet discharge 364, while the sand and dirt exits through a sand and dirt discharge 366.

It will be recognized that while the billet passing through the conveyor/separator 36 has been described as a stream, it is likely the case that the movement of billet through the conveyor/separator 36 may include periods of higher or lower volume, including periods where no billet is passing through the conveyor/separator 36. In fact, the variations in volume may have an impact on the operation of the conveyor/separator 36. For instance, during times of low volume, the depth of billet in the trough 202 may decrease. In such a circumstance, the mechanical scrubbers 272, whose travel has been set to accommodate a much greater depth of billet, may cause billet to be ejected from the billet stream, and, if no other precautions are taken, from the conveyor/separator 36. As such a precaution, as illustrated in FIGS. 6 and 10, a hood 368 may be attached to the side walls 262, 264 of the trough 202 to limit the amount of billet potentially ejected. The hood 368 may extend from a point downstream of the scrubbers 272 to a point upstream of the scrubbers 272, as well as being disposed immediately above the scrubbers 272.

Figure 12:
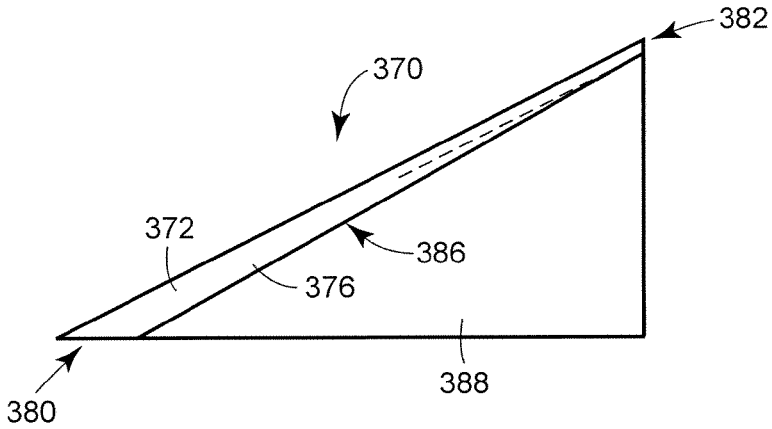
FIG. 12 is an enlarged plan view of a scrubber according to a second embodiment which may be installed for use in the billet conveyor/separator of FIG. 5.
Figure 13:
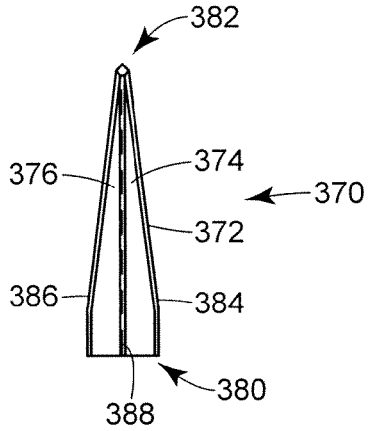
FIG. 13 is an end view of the scrubber of FIG. 12.
Figure 14:
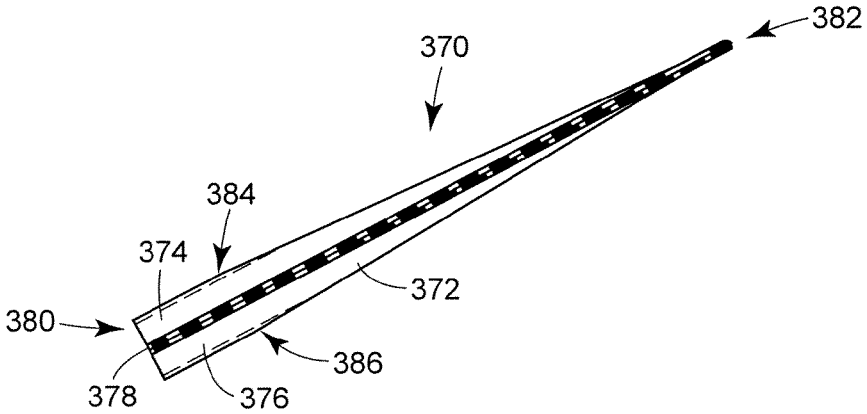
FIG. 14 is a plan view of the scrubber of FIG. 12.

While the billet conveyor/separator 36 has thus been described with the inclusion of mechanical scrubbers 272, other scrubbers may be used in substitution for one or both of the scrubbers 272 between the inlet plate 266 and the separation decks 268, 270. For example, FIGS. 12-14 illustrate an inclined ramp 370. The ramp 370 may be used in conjunction with the billet conveyor/separator 36 to obtain relative motion between the individual billets, thereby enhancing the separation of dirt and sand from the billet.

The ramp 370 includes a V-shaped angle 372 with first and second walls 374, 376 that are joined at a corner 378. The walls 374, 376 are tapered between a first end 380 and a second end 382; that is, outer edges 384, 386 of the walls 374, 376 are spaced further apart at the first end 380 than at the second end 382. The walls 374, 376 are attached at the corner 378 to a rib 388 from their first ends 380 to their second ends 382, although according to other embodiments, the attachment may be intermittent.

The ramp 370 would be installed between the inlet plate 260 and the separation decks 268, 270 by fixedly attaching the ramps 370 to a plate supported between the side walls 262, 264 of the trough 202, for example. The ramps 370 would be positioned so that the first end 380 pointed in the direction of the oncoming billet stream. The ramps 370 would be spaced from each other in the same fashion as the cams 300 are illustrated as spaced from each other in FIG. 10.

In operation, the oncoming billet stream will abut the leading end 380 of the ramp 370 first. Motion of the billet stream will cause individual billets to move along the length of the ramp 370, from the first end 380 to the second end 382. The relative motion between the billet caused by certain billet moving along the ramps 370 is believed to have a scrubbing effect similar to that of the mechanical scrubbers 272 illustrated above.

Similar to the scrubbers 272, it is not necessary to increase the overall height of the conveyor/separator 36 with the ramps 370 as would be the case if the billet was instead permitted to fall through a series of elevations to cause the relative motion of the billet. Unlike the scrubbers 272, the ramps 370 have no moving parts, and thus may require less maintenance than the mechanical scrubbers 272. Also unlike the scrubbers 272, it is believed that the ramps 370 will not have a similar potential for ejecting billet from the conveyor/separator 36 when the depth of the billet in the trough 200 is relatively lower, as may be the case with the mechanical scrubbers 272.

Figure 15:
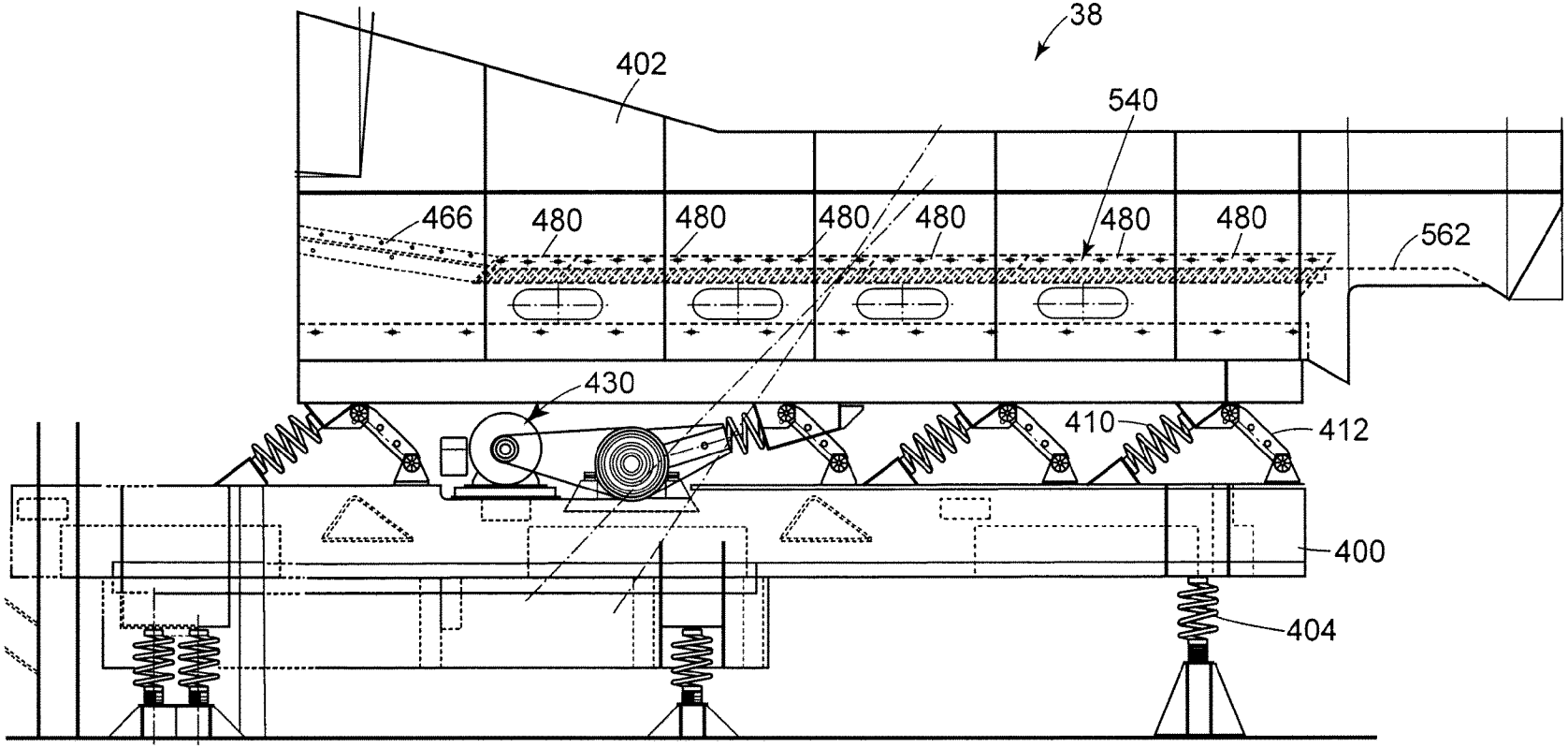
FIG. 15 is a side elevation view of a first embodiment of a bagasse conveyor/separator for use in the system of FIG. 1.

Turning now to a first embodiment of the bagasse conveyor/separator 38 illustrated in FIG. 15, it will be recognized that the bagasse conveyor/separator 38 shares many structures in common with the billet conveyor/separator 36. In this regard, the similarities of the two conveyor/separators 36, 38 will not be discussed in detail, so that the differences may be addressed instead. Similar elements of the two conveyor/separators 36, 38 will be numbered similarly, with those of the bagasse conveyor/separator 38 being offset from those of the billet conveyor/separator 36 by 200 (e.g., the trough of the conveyor/separator 36 is 202, while the trough of the conveyor/separator 38 is 402).

In short, this embodiment of the bagasse conveyor/separator 38 lacks the scrubbers of the billet conveyor/separator 36. Instead, a continuous separation deck 540 is used, the deck 540 including six finger screens 480 between the inlet plate 466 and the discharge plate 562. It is believed that this embodiment of the conveyor/separator 38 would be suitable where an upstream billet conveyor/separator 36 is used, as the sand and dirt to be removed at the subsequent conveyor/separator 36 should be limited.

Figure 16:
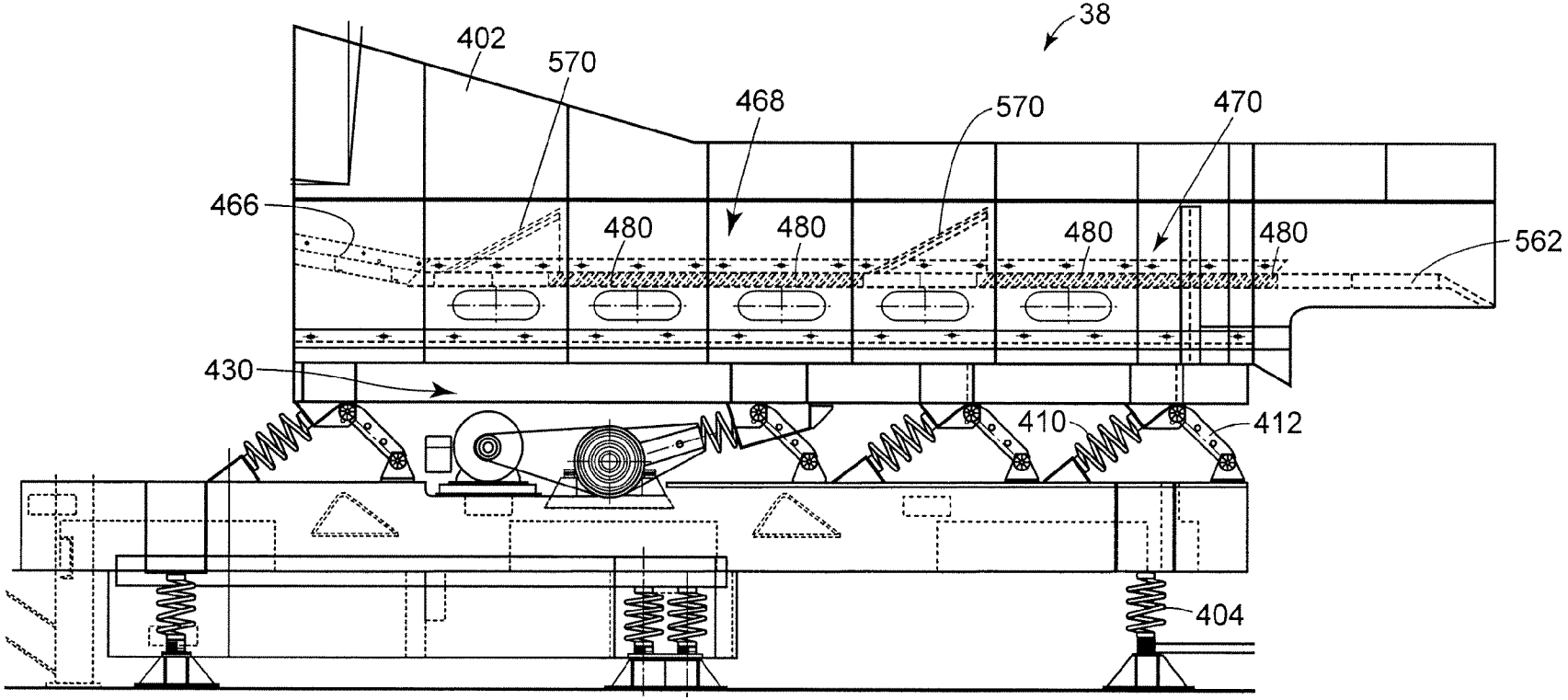
FIG. 16 is a side elevation view of a second embodiment of a bagasse conveyor/separator for use in the system of FIG. 2, the second embodiment of the bagasse conveyor/separator including a plurality of scrubbers.

However, as explained above, the billet conveyor/separator 36 may not be included. As a consequence, a relatively higher percentage of dirt and sand may be passed along from the mill 40 to the remainder of the system, e.g., storage 42 and furnace 44. To limit the amount of dirt and sand in the bagasse, which may thus be passed along with the bagasse to the furnace 44 when burned as fuel, the bagasse conveyor/separator 38 may be fitted with scrubbers as well. FIG. 16 illustrates an embodiment of a bagasse conveyor/separator 38 according to this second embodiment.

In the bagasse conveyor/separator 38 illustrated in FIG. 16, the conveyor/separator 38 includes an inlet plate 466, first and second separation decks 468, 470, and a discharge plate 562. Additionally, disposed between the inlet plate 466 and the first separation deck 468 and between the first and second separation decks 468, 470 are scrubbers 570. The scrubbers 570 as installed are illustrated in FIG. 17, while the structure of the scrubbers 570 is illustrated in greater detail in FIGS. 18-20.

Figure 18:
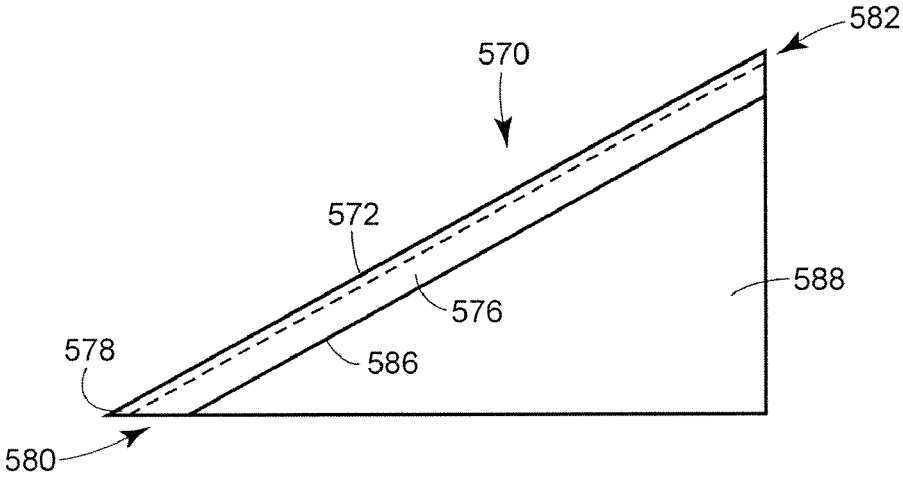
FIG. 18 is a side view of one of the plurality of scrubbers of the bagasse conveyor/separator according to FIG. 16.
Figure 19:
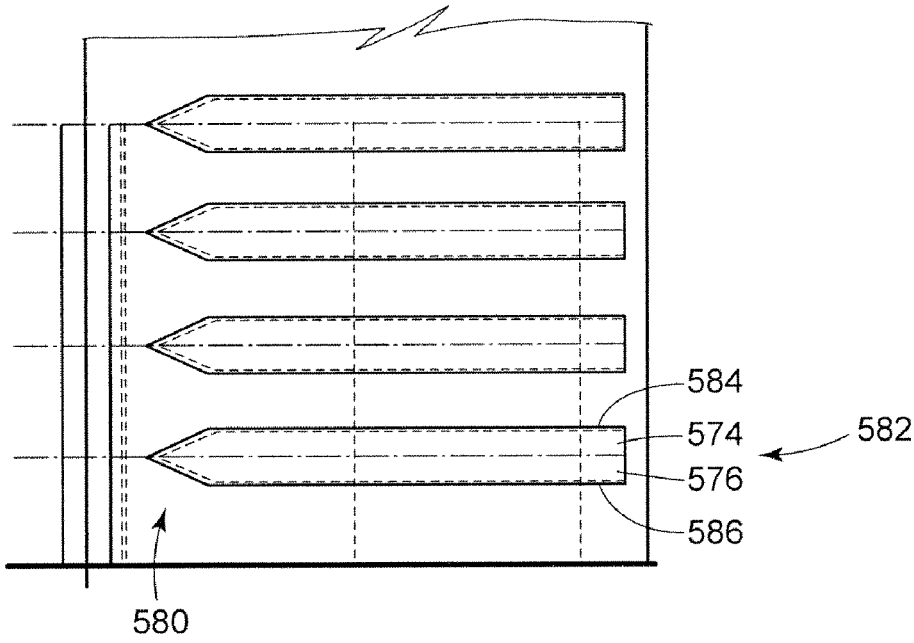
FIG. 19 is an enlarged, partial plan view of a subset of the plurality of scrubbers used in the second embodiment of the bagasse conveyor/separator of FIG. 16.
Figure 20:
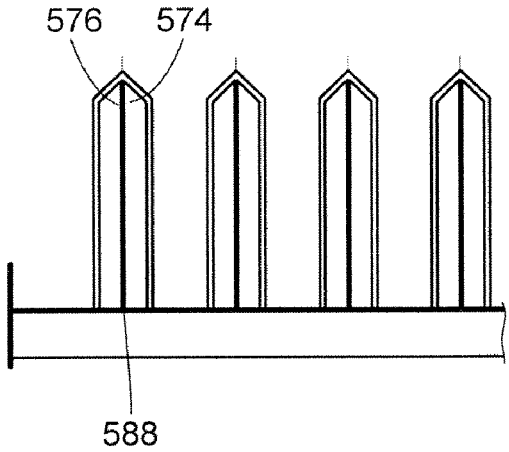
FIG. 20 is an enlarged, partial end view of the subset of the plurality of scrubbers illustrated in FIG. 19.

Turning first to FIGS. 18-20, it will be recognized that the scrubbers 570 have many similarities to the ramps 370 described above, as well as some differences. That is, the scrubbers 570 include an angle 572 with first and second walls 574, 576 attached at a corner 578. Additionally, the angle 572 is attached from a first end 580 to a second end 582 to a rib 588. The scrubbers 570 differ from the ramps 370 in that the edges 584, 586 of the walls 574, 576 are uniformly spaced from each other from the first end 580 to the second end 582.

Figure 17:
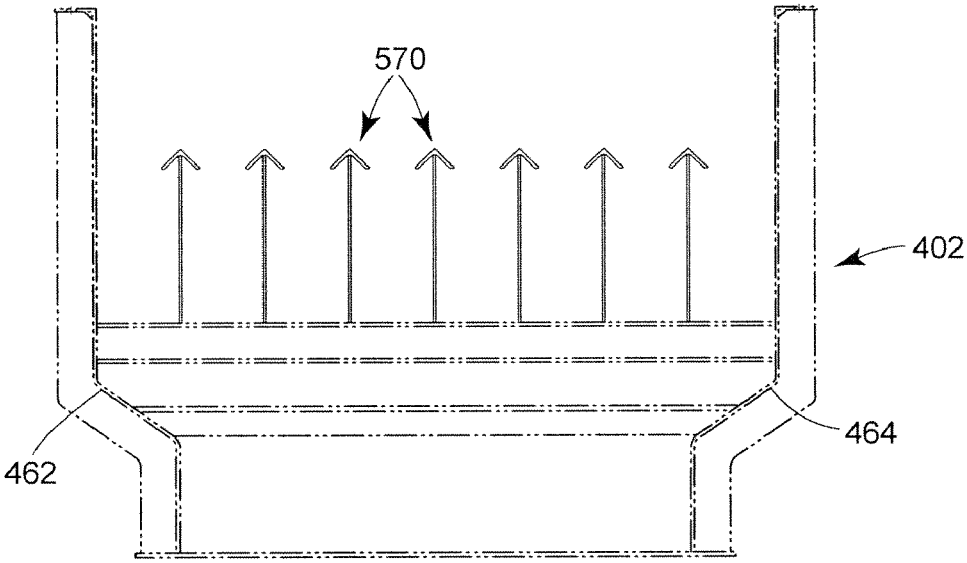
FIG. 17 is an end view of the bagasse conveyor/separator according to FIG. 16, illustrating the plurality of scrubbers.

Moreover, as illustrated in FIG. 17, the scrubbers 570 differ from the ramps 370 in regard to the arrangement of the scrubbers 570 in the trough 402. That is, there are seven of the scrubbers 570 spaced along the width of the trough 202 as illustrated in FIG. 17. By contrast, the ramps 370 would be spaced further apart, such that three or four ramps 370 may be used instead.

We claim:

1. An apparatus for separating a mixed material into constituent materials, the apparatus comprising:

a separation deck free of stepwise changes in elevation between a first deck end and a second deck end, the separation deck comprising a plurality of spaces through which a constituent material may pass;

a plurality of scrubbers disposed on the deck, each of the plurality of scrubbers comprising a cam having a first end that is movable relative to the deck such that, in a first state, the first end of the cam is disposed at a higher elevation than the deck; and a vibratory generator coupled to the deck, the mixed material moving over the deck and the scrubbers from the first deck end to the second deck end by the motion imparted by the vibratory generator, components of the mixed material moved relative to each other as the components move over the scrubbers, thereby causing the constituents material attached to the components of the mixed material to separate and pass through the spaces in the separation deck.

2. The apparatus according to claim 1, wherein the separation deck comprises at least one finger screen.

3. The apparatus according to claim 1, wherein the cam is coupled to a drive section that moves the first end between the first state and a second state wherein the first end of the cam is disposed at an elevation at least equal to that of the deck.

4. A system comprising:

a separator for separating a mixed material into constituent materials, the apparatus comprising:

a separation deck free of stepwise changes in elevation between a first deck end and a second deck end, the separation deck comprising a plurality of spaces through which a constituent material may pass;

a plurality of scrubbers disposed on the deck, the plurality of scrubbers having a first end disposed at a higher elevation than the deck in at least a first state; and a vibratory generator coupled to the deck, the mixed material moving over the deck and the scrubbers from the first deck end to the second deck end by the motion imparted by the vibratory generator, components of the mixed material moved relative to each other as the components move over the scrubbers, thereby causing the constituents material attached to the components of the mixed material to separate and pass through the spaces in the separation deck; and a furnace coupled to the separator, at least a portion of the materials moving over the deck and the scrubbers of the separator being directed into the furnace.

5. The system according to claim 4, comprising;

another separator for separating a mixed material into constituent materials, the another separator comprising:

a separation deck free of stepwise changes in elevation between a first deck end and a second deck end, the separation deck comprising a plurality of spaces through which a constituent material may pass;

a plurality of scrubbers disposed on the deck, the plurality of scrubbers having a first end disposed at a higher elevation than the deck in at least a first state; and a vibratory generator coupled to the deck, the mixed material moving over the deck and the scrubbers from the first deck end to the second deck end by the motion imparted by the vibratory generator, components of the mixed material moved relative to each other as the components move over the scrubbers, thereby causing the constituents material attached to the components of the mixed material to separate and pass through the spaces in the separation deck the another separator coupled between the separator and the furnace, at least a portion of the materials moving over the deck and the scrubbers of the another separator being directed into the furnace.

6. The system according to claim 5, comprising:

storage coupled to the another separator, at least a portion of the materials moving over the deck and the scrubbers of the another separator being directed into the storage.

7. The system according to claim 6, wherein the storage is coupled to the furnace, at least a portion of the materials in storage being directed into the furnace.

8. The system according to claim 4, comprising a distributor coupled to the separator, the distributor comprising:

a trough comprising a plurality of trough segments, each trough segment comprising opposing plates, opposing spaced edges of the opposing plates of each trough segment defining, in part, a discharge opening; and a vibratory generator coupled to the trough.

9. The system according to claim 8, wherein the trough has a first trough end and a second trough end, and the spacing between the opposing edges of the opposing plates of the trough segments closer to the first trough end being different than the spacing between the opposing edges of the opposing plates of the trough segments closer to the second trough end.

10. A method of separating a mixed material into constituent materials, the method comprising:

moving a mixed material along a separation deck, the separation deck free of stepwise changes in elevation between a first deck end and a second deck end, the separation deck comprising a plurality of spaces through which a constituent material may pass;

contacting the mixed material with a plurality of scrubbers disposed on the deck, the plurality of scrubbers having a first end disposed at a higher elevation than the deck in at least a first state, components of the mixed material moving relative to each other as the components move over the scrubbers, thereby causing the constituents material attached to the components of the mixed material to separate and pass through the spaces in the separation deck;

transporting at least a portion of the mixed material moving over the deck and the scrubbers into a furnace; and burning the at least a portion of the mixed material transported into the furnace.

11. The method according to claim 10, each of the plurality of scrubbers comprises a ramp having a first end disposed in the direction of the first deck end and a second end having a higher elevation that the first end of the ramp relative to the separation deck, and comprising:

moving the mixed material over the ramps from the first end to the second end of the ramps as the mixed material moves from the first end to the second end of the deck.

12. The method according to claim 10, each of the plurality of scrubbers comprise a cam having a first end that is movable relative to the deck such that, in a first state, the first end of the cam is disposed at an elevation higher than the deck, and comprising:

moving the mixed material from the first end to the second end of the deck as the first end of the cam is moved between a second state wherein the first end of the cam is disposed at an elevation at least equal to that of the deck and the first state.

13. The method according to claim 10, comprising:

feeding a mixed material onto the separation deck, the mixed material comprising billet and sand or dirt.

14. The method according to claim 10, comprising:

feeding a mixed material onto the separation deck, the mixed material comprising bagasse and sand or dirt.

15. The method according to claim 10, comprising:

transporting at least a portion of the mixed material moving over the deck and the scrubbers into storage.

16. The system according to claim 4, wherein each of the plurality of scrubbers comprises a ramp having a first end disposed in the direction of the first deck end and a second end having a higher elevation that the first end of the ramp relative to the separation deck.

17. The system according to claim 16, wherein the ramp comprises an angle that depends from the first end to the second end of the ramp with its apex disposed upwardly.

18. The system according to claim 4, wherein each of the plurality of scrubbers comprises a cam having a first end that is movable relative to the deck such that, in a first state, the first end of the cam is disposed at an elevation higher than the deck.

* * * * *